United States Patent [19]

Garrett

[11] 4,383,900

[45] May 17, 1983

[54] APPARATUS AND METHOD FOR MEASURING THE IR DROP FREE CATHODIC PROTECTION POTENTIAL CREATED BY A RECTIFIER AND CONTROLLING RECTIFIER OPERATION TO ACHIEVE A DESIRED LEVEL THEREOF

[75] Inventor: John I. Garrett, Ogallala, Nebr.

[73] Assignee: Good-All Electric Company, Inc., Ogallala, Nebr.

[21] Appl. No.: 252,576

[22] Filed: Apr. 9, 1981

[51] Int. Cl.[3] ..... C23F 13/00

[52] U.S. Cl. ..... 204/147; 204/196; 307/95

[58] Field of Search ..... 204/147, 196; 307/95

[56] References Cited

U.S. PATENT DOCUMENTS

| | | | |
|---|---|---|---|
| 3,634,222 | 1/1972 | Stephens | 204/196 |
| 4,080,272 | 3/1978 | Perry et al. | 204/196 |
| 4,080,565 | 3/1978 | Polak et al. | 204/196 |
| 4,160,171 | 7/1979 | Merrick | 307/95 |
| 4,255,242 | 3/1981 | Freeman | 204/147 |

*Primary Examiner*—T. Tung

*Attorney, Agent, or Firm*—Rogers, Eilers & Howell

[57] ABSTRACT

An electronic circuit for measuring the IR drop free potential of a cathodically protected structure includes a shunting transistor which is periodically pulsed on to shunt or electrically connect the output lines of a rectifier to force the voltage and current delivered to a structure being cathodically protected to zero. The reference cell potential is measured during this zero or sampling time and a minimum value detected by a detector circuit which holds the value until changed in successive sampling periods. The minimum reference cell potential is then compared to a voltage corresponding to a desired reference cell potential and the difference used to generate a firing voltage for SCRs in the rectifier and thereby control its output to achieve the desired level of cathodic protection.

29 Claims, 3 Drawing Figures

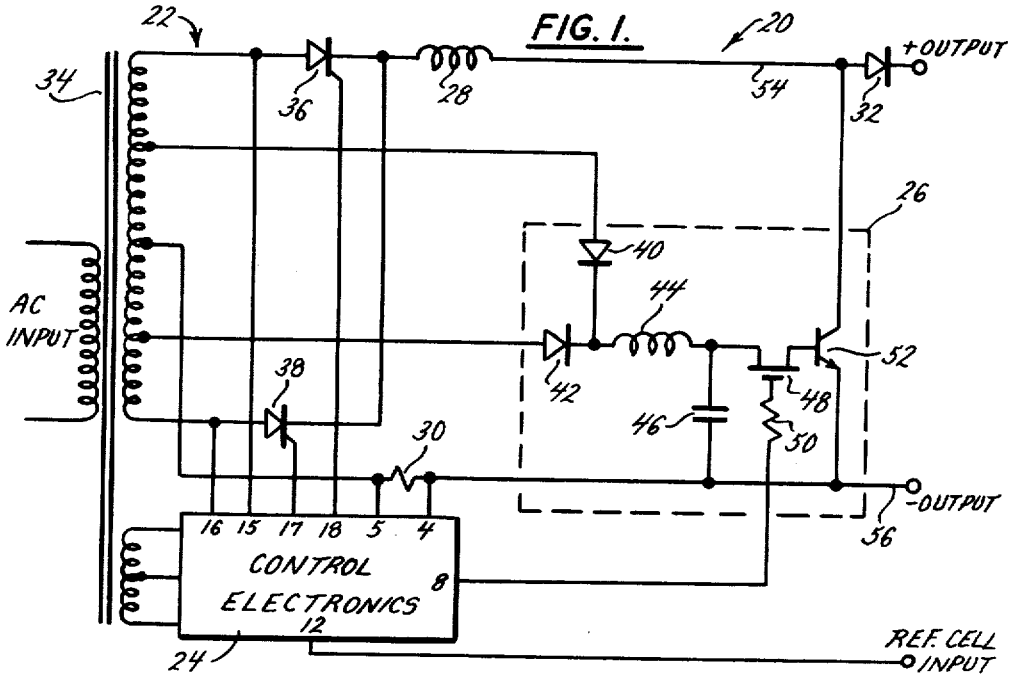
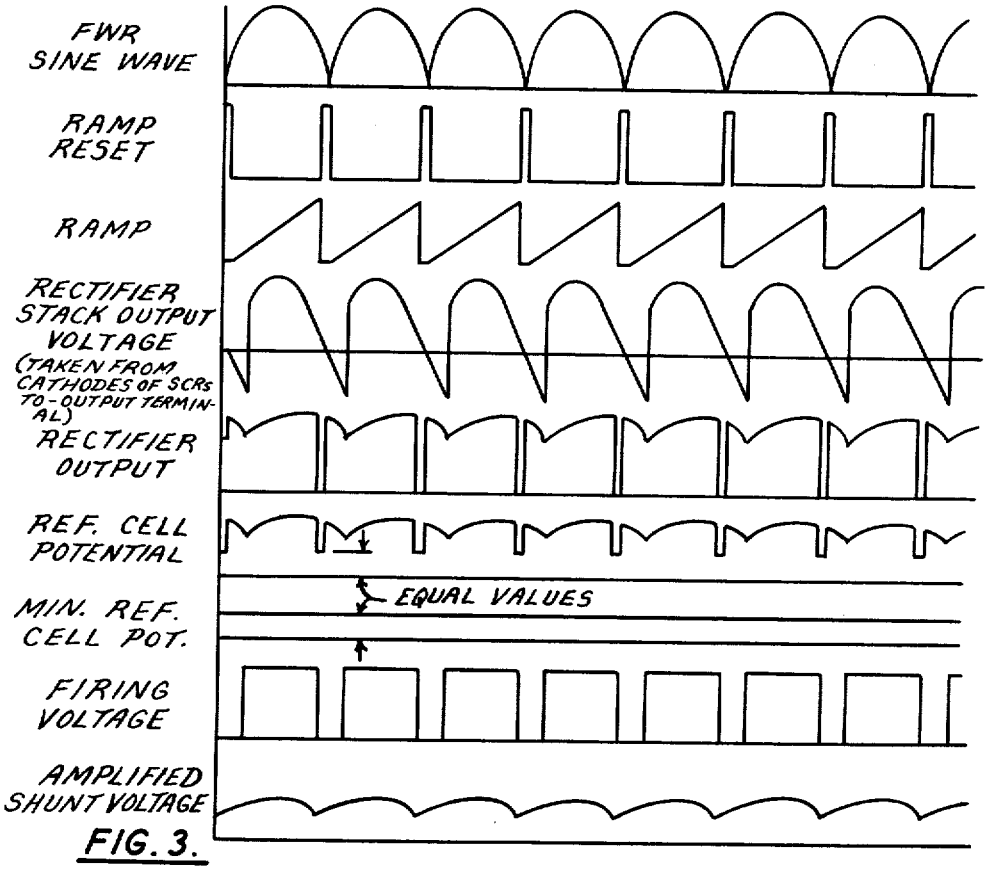
FIG. 3.

APPARATUS AND METHOD FOR MEASURING THE IR DROP FREE CATHODIC PROTECTION POTENTIAL CREATED BY A RECTIFIER AND CONTROLLING RECTIFIER OPERATION TO ACHIEVE A DESIRED LEVEL THEREOF

BACKGROUND AND SUMMARY OF THE INVENTION

Rectifiers have been used for many years to supply a structure with an impressed current to retard its corrosion. The impressed current creates a potential between the structure and the material surrounding it which opposes the electrolytic action which would otherwise accelerate the corrosive forces present in a mixed medium. This technique is generally referred to as cathodic protection.

The generally accepted parameter which is used to determine if sufficient cathodic protection current is being supplied is to measure the potential between the structure and a reference electrode, or reference cell. A lower or higher potential is usually indicative of a lower or higher amount of cathodic protection and is also directly related to a lower or higher amount of cathodic protection current being delivered by a rectifier or the like. A serious problem in measuring or monitoring the potential between the structure and the reference cell is that when the rectifier is delivering current, there is an associated IR drop due to the surrounding material spaced between the cathode created at the structure and the reference half cell. As the amount of IR drop is directly dependent upon the properties of the electrolyte and the distance between the cathode and referene half cell, it is virtually impossible to measure with any accuracy the impressed potential, and hence the amount of protection, while the rectifier is delivering current to the structure.

In the prior art, this problem has been addressed by various schemes such as those disclosed in U.S. Pat. Nos. 3,634,222 and 4,080,272. The first of these U.S. Pat. No. 3,634,222, discloses and claims a circuit which is particularly adapted for use with an SCR type rectifier in which the anode current is interrupted or turned off for a brief amount of time. During a first portion of this off time, the current is allowed to decay and the sampling takes place in a second portion of the off time. The SCR is then turned back on and rectifier output is resumed. In U.S. Pat. No. 4,080,272, the operation of the rectifier is not interrupted. Instead, the rectifier is designed so that its output voltage crosses through zero every half cycle with the sampling taking place during this zero voltage condition. As can be appreciated, neither of these schemes can be used with a rectifier having output chokes or efficiency filters which smooth the output waveform and which maximize the conversion efficiency of the rectifier. This is because both of these schemes rely upon the rapid decay to zero or the periodic crossing through zero voltage in the rectifier output. With a choke or efficiency filter, decay is greatly retarded (intentionally) which would prevent either of these methods from being effective in measuring the IR drop free minimum potential between the structure and a reference half cell.

Another disadvantage with the methods described in both of these prior art patents is that the sample of potential is taken relatively soon after the output current reaches a zero value. The actual minimum potential may actually occur at a time just before the rectifier output is re-established, or later in the sampling time period. Furthermore, neither of these references describes a circuit which "tracks" the minimum potential measured, and instead suggests that this sampling potential is a singular value which can be measured and stored at a particular point in time. As the system is a dynamic system, with currents and voltages decaying and being re-established on a periodic basis, it is impossible that this is the case. Instead, it is more probable that the minimum potential could occur for only a short period of time during the sampling time and at a different point in time for different output currents. However, with the circuits of the prior art, there is no means to discriminate between any of the different values which might be available during the sampling period.

Another problem in the prior art has been to combine one of these patented methods of measuring IR drop free minimum reference cell potential with a rectifier suitable for use under conditions requiring low voltage and high current output. For example, in a bridge type rectifier using at least two blocking diodes in the bridge, the SCRs are fired on for only a short period of time to deliver the required low output voltage, and the blocking diodes prevent the flow of current through the transformer at those times other than when the voltage across the transformer is positive. Thus, the output current must flow during a relatively low percentage of time with the output being zero during a large portion of each half cycle. The use of an output choke with a four SCR bridge circuit would permit positive output current under negative transformer voltage conditions although this is a much more expensive design requiring much more complicated control circuitry to achieve the firing of all of the SCRs. Furthermore the output current does not necessarily go to zero which makes this configuration unsuitable for use with the sampling method disclosed in U.S. Pat. No. 4,080,272.

A circuit which has been used in these low voltage, high current applications has a center tap transformer with two SCRs in each of the legs and a choke in one of the output lines. The action of the choke and the elimination of the blocking diodes permits the flow of current through the transformer and into the load even under negative voltage conditions. Thus, with the center tap, two SCR, choke type design a lower RMS current is experienced as current is conducted for a longer period of time in each cycle. This results in better operation, and the ability to use lower capacity components for any particular application over that required in the bridge type design having two blocking diodes. Unfortunately, neither method of the prior art for detecting the minimum reference cell potential can be used with this center tap, two SCR, choke type design as the output current never falls to zero. Thus, there is no sampling time available for measuring the minimum reference cell potential and merely turning off the SCrs does not achieve zero current output because of the action of the choke.

To solve these and other problems in the prior art, applicant has succeeded in designing and developing a rectifier control which is suitable for used with a center tap, two SCR, choke design and which measures the IR drop free minimum reference cell potential at its lowest value during its sampling period and automatically adjusts the output of the rectifier to achieve the desired cathodic protection potential. As applicant's design continuously monitors the reference cell potential, if the rectifier output falls to zero during normal operation the minimum reference cell potential is picked up and used to modify the phase angle at which the SCRs are fired. Thus, applicant's design is the first design which continuously monitors the minimum reference cell potential and is not limited to a defined portion of the waveform which could result in incorrectly higher readings and a lower protective current delivered to the structure than is desired.

Applicant's design generally includes a shunting transistor circuit which is periodically pulsed on to shunt or electrically connect the output lines of the rectifier and thus force the voltage and current delivered to the structure to zero. The reference cell potential is input to a minimum detector circuit which continuously monitors it but which holds the minimum value which exists as a result of the diversion or interruption of the output current. This minimum reference cell potential is then compared to a voltage corresponding to the desired reference cell potential and the amplified difference represents an error signal which is compared to a ramp voltage and used to generate a firing voltage for the SCRs. By using a shunting transistor, a choke or other impedance may be provided in the output of the rectifier which maintains the current through the transformer and permits sharp switching of the output. As the SCRs themselves are not used to create the zero output condition, use of the choke is feasible as well as efficiency filters which greatly increase the conversion efficiency and effectiveness of the rectifier itself. Of course, as applicant's device independently creates a "zero" output condition, it may be used with three phase rectifiers as well as single phase rectifiers unlike the method described in U.S. Pat. No. 4,080,272 which is limited to single phase circuits as it requires a zero crossing point in the rectifier output itself.

These and other advantages may be more fully appreciated by referring to the drawings and the description of the preferred embodiment which follows.

BRIEF DESCRIPTION OF THE DRAWINGS

FIG. 1 is a schematic diagram of the rectifier and control showing the connections for the control electronics and their interconnection with the shunting transistor circuit, SCRs, transformer, and reference cell input;

FIG. 3 depicts the waveforms to be expected at various points in the control electronics circuit during a typical operational sequence.

DETAILED DESCRIPTION OF THE PREFERRED EMBODIMENT

Figure 2:
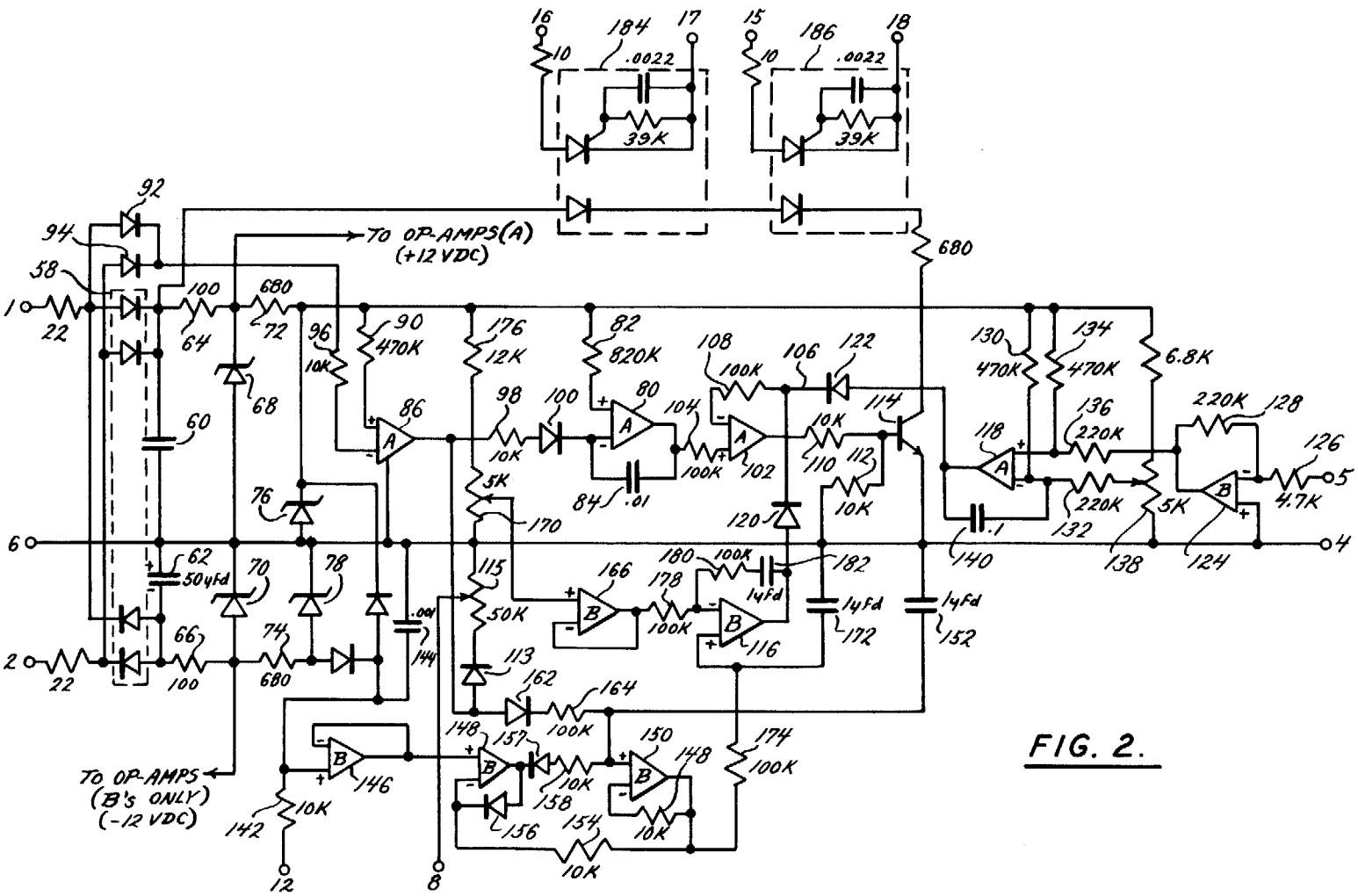
FIG. 2 is a schematic diagram of the control electronics shown in block form in FIG. 1 with the output lines numbered to correspond thereto.

Applicant's rectifier control 20 is shown in circuit with a rectifier 22 in FIG. 1 and generally includes a control electronics package 24 and a shunting transistor circuit package 26. A choke 28, shunt 30 and output diode 32 are the other components shown as part of the system. Of course, the rectifier 22 includes an A-C transformer 34 and SCRs 36, 38, as is known in the art.

The shunting transistor circuit 26 includes diodes 40, 42; a filter circuit comprised of coil 44 and capacitor 46; a field effect switching transistor 48 with gate resistor 50; and the shunt transistor 52. The operation of the shunting transistor circuit 26 is straight forward. Diodes 40, 42 maintain a charge on capacitor 46 such that when terminal 8 of control electronics package 24 is pulsed, the field effect transistor 48 goes into conduction which turns on shunt transistor 52 which electrically connects output lines 54, 56 of the rectifier 22.

The control electronics package 24 is shown in greater detail in FIG. 2 and includes terminal connections 1, 2, and 6 representing a center tap connection to transformer 34. Terminal connection number 6 is a common line for the circuit. A filtered positive and negative D-C voltage is generated from this center tapped A-C input at terminals 1, 2, and 6 by diode 58. Capacitors 60, 62 maintain this negative and positive D-C voltage which is further reduced and regulated by resistors 64, 66 and zener diodes 68, 70. A second stage of reduction and regulation is provided by resistors 72, 74 and zener diodes 76, 78 for control and surge protection purposes.

In applicant's circuit, two different types of operational amplifiers are used. The first of these is designated as a type A which shall correspond to a "Norton amplifier". The second of these is designated type B and corresponds to a conventional operational amplifier. A ramp voltage (as shown in FIG. 3) is generated by op amp 80. A fixed current is supplied to the positive inputs of op amp 80 through resistor 82 and an equal amount of current is applied to the negative input of op amp 80 through feedback capacitor 84. This is a typical connection for an integrater circuit and the output voltage produced by op amp 80 is a ramp. The ramp voltage starts at zero volts just after the zero crossing of the A-C waveform and increases to about six volts at the end of each half cycle. The ramp function is stabilized and reset by a "ramp reset" current generated by op amp 86. The output of op amp 86 is shown in FIG. 3 and is generated by using a fixed input current through the combined action of zener diode 76 and resistor 90 and a full wave rectified sine wave current generated through the action of diodes 92, 94 and resistor 96 applied to the negative input. The ramp reset is input to the negative terminal of op amp 80 through resistor 98 and diode 100, as shown. The ramp voltage from op amp 80 is used to apply a ramp current to the positive input of op amp 102 through resistor 104. A current is applied to the negative input of op amp 102 by the voltage at control bus 106 through resistor 108. The output of op amp 102 is the SCR firing voltage which returns to common through resistors 110, 112 to turn on the firing transistor 114. The ramp reset signal generated by op amp 86 is also used to periodically trigger the shunting transistor circuit 26 and create a zero output condition necessary to sample the minimum reference cell potential. The output of op amp 86 flows through diode 113 and generates a voltage across adjustable resistor 115, a portion of which is tapped off for terminal connection 8. As shown in FIG. 3, the pulse width of the ramp reset function defines the time period during which the shunting transistor 52 is turned on and thus the sampling period. Applicant has found that tying the triggering of the shunting transistor to the sine wave greatly reduces problems in stabilizing the operation of the circuit, although other known techniques may be used as well.

As can be appreciated, the higher the potential at control bus 106, the latter in the half cycle the SCRs will fire and the lower the output voltage of the rectifier 22 will be. In this manner, the control bus 106 voltage can control the output voltage of the rectifier 22. The voltage on control bus 106 is determined by the higher of the voltages from op amp 116 and op amp 118 which are connected through diodes 120, 122 in an "OR " connection to control bus 106.

When op amp 118 is controlling the voltage at control bus 106, the circuit is in "current limit" which indicates that rectifier 22 is operating at its uppermost desired current output and this portion of applicant's circuit is limiting the firing angle of the SCRs 36, 38 to within the desired circuit current levels. The shunt 30 voltage is input at terminal connections 4 and 5 as shown in FIG. 2, which is input to op amp 124 which along with resistors 126, 128 produce an amplified shunt voltage (as shown in FIG. 3) at the output thereof. Op amp 118 functions as a comparator of voltages developed across resistors 130, 132, 134, 136 as modified by the output of op amp 124 through adjustable resistors 138. By changing the setting of adjustable resistor 138, the current limit setting for the control electronics package 24 may be adjusted. Capacitor 140 acts as a filter and provides some frequency compensation in the current control loop of this circuit.

As mentioned above, during normal operation the current limit circuit will not affect the firing angle of the SCRs, and instead the following portion of the circuit will control their operation. The reference cell potential is input to the control electronics package 24 at terminal 12 through resistor 142 and capacitor 144. These two components form an input filter with a "corner" at approximately 15,000 hertz to filter out any spurious ripple which might otherwise cause errors in the "captured" reference cell potential. Input op amp 146 is used as a buffer amplifier to maintain a high input impedance to the reference cell input. Op amps 148, 150 and their associated circuit components form the minimum detector circuit which detects and holds a minimum reference cell potential (see FIG. 3) on capacitor 152. Briefly, the operation of this circuit may be best explained by assuming a potential of V1 on capacitor 152. As op amp 150 is a unity gain buffer amplifier, its output voltage tracks its input and is V1. V1 is applied to the negative input of op amp 148 through resistor 154, except as modified by diode 156. The output of op amp 148 responds to keep the negative input equal to its positive input when the potential from op amp 146 is greater than V1. During the time when the output of op amp 146 is greater than the output of op amp 150, diode 157 is reverse biased and no change of voltage occurs on capacitor 152. When the output of op amp 146 reaches the value V1 or less, the output of op amp 148 must respond to lower the value of V1 to a new value equal to the minimum value of the voltage from op amp 146 due to the direct feedback from op amp 150 to op amp 148 through resistor 154, with diode 156 being reverse biased. Thus, with the negative input being greater than the positive input of op amp 148, its output decreases which forward biases diode 157 and creates a voltage differential across resistors 158 which reduces the voltage on capacitor 152.

Similarly, if the minimum value of the reference cell signal is increasing, it is desired that the voltage on capacitor 152 follow that minimum value upwards. To achieve this, a pulse of voltage is supplied by the output of op amp 86 through diode 162 and resistor 164. Thus the voltage on capacitor 152 can be increased by this action but its value is kept at the minimum reference cell potential value by the minimum detector circuit. This detected minimum reference cell potential is compared with a desired minimum reference cell potential (corresponding to a desired level of cathodic protection) by op amps 166, 116, and adjustable resistor 170. The minimum reference cell potential which appears at the output of op amp 150 is applied to the positive input of op amp 116 through resistor 174. Resistor 174 and capacitor 172 form part of the frequency compensation of the control loop. A preselected constant D-C voltage is developed across the adjustable resistor 170 in series with resistor 176 and input to the positive terminal of op amp 166. Op amp 166 serves as a buffer amplifier to prevent excessive current or voltage loading in adjustable resistor 170. Resistors 178, 180 and capacitor 182 complete the comparator and frequency compensation circuitry to stabilize the operation of op amp 116 which compares the desired minimum potential with the measured minimum reference cell potential to create an error signal at its output. This error signal is fed to the control bus 106 through diode 120, as previously mentioned. Opto-coupler firing circuits 184, 186 are connected between terminals 16, 17 and 15, 18, respectively and fire SCRs 36, 38 as the firing voltage is generated at the output of op amp 102.

OPERATION

During operation of applicant's invention, a center tap, two SCR, choke rectifier produces an output to a structure to provide it with cathodic protection. As shown in FIG. 1, this voltage and current is developed through its output lines. Once every half cycle, a pulse is generated which triggers the operation of the shunting transistor circuit which electrically connects the output lines to "short out" the voltage and current from the load. At this point, the minimum detector portion of applicant's control electronics circuit detects the minimum reference cell voltage which instantaneously appears at any time during this "shorted out" condition and adjusts the firing angle for the SCRs for the next half cycle. A blocking diode prevents any current from flowing back from the load through the shunting transistor circuit which might otherwise detract from the cathodic protection field created by action of the rectifier. The blocking diode 32 also provides some voltage offset to prevent the "on" voltage at the collector of transistor 52 from supplying a small residual current to the structure. As the minimum detector circuit is continuously monitoring the reference cell voltage, if at any time during the normal operation of the rectifier the output voltage and current pass through zero, then the minimum detector circuit senses any possibly lower potential which exists and adjusts the firing angle of the SCRs accordingly. Thus, applicant's circuit is not locked into a particular fixed sampling period and instead is capable of acting at any time there is a possibility of a reduction in the effective level of cathodic protection provided by the rectifier.

Although applicant's circuit utilizes a ramp reset to trigger its sampling function, it is to be understood that other timing circuits could be used as well and is independent of the firing circuitry for the SCRs.

As is shown in FIG. 3, the rectifier stack output voltage (which is taken between the cathodes of the SCRs and the negative output line) a negative voltage can appear across the secondary of the transformer but a positive current may be delivered and flow therethrough by the action of the choke. As explained above, this provides a real advantage in those applications of low voltage and high current. If blocking diodes in a bridge arrangement were used, then current flow would be interrupted for those portions of the half cycle where the diodes would be reverse biased.

Various changes and modifications to applicant's invention would be apparent to one of ordinary skill in the art. These changes and modifications are included within the scope of applicant's teaching and he intends that his invention be limited only by the scope of the claims appended hereto.

I claim:

1. A device to measure the IR drop free cathodic protection potential imposed on a structure by a rectifier by measuring the potential between said structure and a reference cell, said device being capable of taking its measurement at any point in the rectifier output waveform, said device comprising means to selectively electrically connect the rectifier output lines and thereby force the voltage delivered to the structure to zero for a period of time, said rectifier having an efficiency filter to smooth the rectifier output, the efficiency filter being connected ahead of the rectifier output line so that its output is shunted by the electrical connection means, and means to continuously detect for the minimum potential between said structure and said reference cell during said period of zero output voltage and store same.

2. The device of claim 1 wherein the efficiency filter includes an impedance means to prevent excessive current through the electrically connecting means when said rectifier output lines are electrically connected.

3. The device of claim 2 wherein said impedance means is a choke.

4. The device of claim 1 wherein said device has means to repeatedly sample said minimum potential.

5. The device of claim 3 wherein said device has means to sample for each half cycle of the A-C input voltage to the rectifier.

6. The device of claim 1 further comprising a rectifier control, said control having means to adjust rectifier output in accordance with said minimum potential to maintain a preselected level of cathodic protection.

7. The device of claim 6 wherein said rectifier includes at least one SCR to rectify the A-C input voltage, said rectifier control including means to generate a firing voltage for said SCR at least partially in response to the minimum potential.

8. The device of claim 7 further comprising means to generate a voltage corresponding to a preselected level of cathodic protection, means to compare said generated voltage with the minimum potential and generate a first difference voltage in response thereto, and means to generate a periodically recurring ramp voltage, said firing voltage being generated in response to a comparison between said ramp voltage and said first difference voltage.

9. The device of claim 8 further comprising means to generate a periodically occurring ramp reset voltage.

10. The device of claim 9 wherein said ramp reset voltage is utilized to trigger the electrical connection of the rectifier output lines.

11. The device of claim 10 wherein a transistor device is connected between said rectifier output lines and is used to electrically connect said output lines.

12. The device of claim 11 wherein said transistor device is energized only for the duration of said ramp reset voltage.

13. The device of claim 8 wherein said rectifier control further comprises means to generate a first voltage corresponding to the output current of the rectifier, means to generate a second voltage corresponding to a desired preselected maximum output current, means to compare said first and second voltages and generate a current difference voltage, and means to override the control of the firing voltage by said first difference voltage if said current difference voltage exceeds a predetermined value.

14. The device of claim 1 further comprising means to prevent current flow from the structure into the rectifier output line connecting means.

15. The device of claim 14 wherein said current flow prevention means is a diode.

16. A rectifier control which measures the IR drop free cathodic protection potential imposed on a structure by measuring the potential between said structure and a reference cell, said control being capable of taking its measurement at any point in the rectifier output waveform, and which maintains a preselected level of protection by using the measured potential to at least partially control the operation of its associated rectifier, said rectifier including at least one SCR to rectify an input A-C voltage and a choke in its output line to smooth its output waveform, said control including a transistor device to selectively electrically connect the rectifier output lines and thereby force the voltage delivered to the structure to zero for a period of time, means to continuously detect for the minimum potential between said structure and said reference cell during said period of zero output voltage and store same, means to generate a first voltage corresponding to a preselected level of cathodic protection, and means to generate a firing voltage to control said SCR at least partially in response to a comparison of said first voltage and said minimum potential, said control thereby maintaining a desired level of cathodic protection in response to the IR drop free potential.

17. The device of claim 16 further comprising means to periodically cause the measurement of the minimum potential.

18. The device of claim 16 further comprising a diode to prevent any current flow from the structure through the transistor device.

19. The device of claim 16 further comprising a shunt in circuit with said rectifier, said shunt generating a voltage corresponding to the rectifier output current, means to generate a voltage corresponding to the maximum desired current, and means to compare said voltage and override the firing voltage generating means to limit rectifier output current.

20. A method for measuring the IR drop free cathodic protection potential imposed on a structure by a rectifier at any point in the rectifier output waveform comprising the steps of: filtering the rectifier output with an efficiency filter, electrically connecting the output lines of the rectifier and thereby forcing the voltage delivered to the structure to zero for a period of time, continuously detecting for the minimum potential between said structure and a reference cell during the period of zero voltage, and storing said minimum detected potential.

21. The method of claim 20 further comprising the step of controlling rectifier output in response to the measured IR drop free potential to maintain a preselected level of cathodic protection.

22. The method of claim 21 further comprising the step of preventing excessive current when said rectifier output lines are electrically connected.

23. The method of claim 21 wherein the rectifier includes at least one SCR to rectify the A-C input voltage and further comprising the step of generating a firing voltage for said SCR at least partially in response to the minimum potential.

24. The method of claim 23 further comprising the steps of generating a voltage corresponding to a preselected level of cathodic protection, comparing the generated voltage with the minimum potential and generating a first difference voltage in response thereto, and generating a periodically recurring ramp voltage, said firing voltage being generated in response to a comparison between said ramp voltage and said first difference voltage.

25. The method of claim 24 further comprising the steps of generating a periodically occurring ramp reset voltage, and triggering the electrical connection of the rectifier output lines with said ramp reset voltage.

26. The method of claim 24 further comprising the steps of generating a first voltage corresponding to the output current of the rectifier, generating a second voltage corresponding to a desired preselected maximum output current, comparing said first and second voltages and generating a current difference voltage, and overriding the control of the firing voltage by said first difference voltage if said current difference voltage exceeds a predetermined value.

27. The method of claim 20 further comprising the step of repeatedly measuring the minimum potential.

28. The method of claim 20 further comprising the step of preventing current flow from the structure through the electrical connection between the rectifier output lines.

29. A method of controlling the operation of a rectifier to maintain a constant IR drop free potential between a structure being cathodically protected and a reference cell, the rectifier having at least one SCR to rectify the A-C input voltage and a choke in its output line, comprising the steps of intermittently electrically connecting the output lines of the rectifier, limiting the current flow through the output lines when they are electrically connected, continuously measuring the minimum potential between the structure and the reference cell when the output lines are connected, storing the minimum potential, generating a voltage corresponding to a desired minimum potential, comparing said measured minimum potential and said desired minimum potential and generating a firing voltage for said SCR at least partially in response to said comparison.

* * * * *